United States Patent [19]

Wright

[11] Patent Number: 4,726,312

[45] Date of Patent: Feb. 23, 1988

[54] ACCESSORY FOR YACHTS

[76] Inventor: Brian L. Wright, 338 Bideford Green, Linslade, Beds. LU77TX, England

[21] Appl. No.: 920,971

[22] Filed: Oct. 20, 1986

[51] Int. Cl.[4] ..... B63B 21/16

[52] U.S. Cl. ..... 114/221 R; 403/16; 254/266; 254/369; 254/371

[58] Field of Search ..... 114/218, 221 R; 403/16, 403/334; 254/266, 369, 371

[56] References Cited

U.S. PATENT DOCUMENTS 985,491 2/1911 Andrade, Jr. ..... 403/16 X 4,358,281 11/1982 Woodward ..... 114/218

4,582,444 4/1986 Miskinis ..... 403/16

*Primary Examiner*—Sherman D. Basinger

[57] ABSTRACT

An accessory or an accessory mount for a yacht comprises a device (1) not involved with the normal operation of a winch and having an integral supporting leg (3) which is adapted to locate in the handle receiving socket of a winch. The leg (3) is designed to be a jamm fit in the handle receiving socket, and has a thread (5) at least towards its upper end. A threaded ring (6) engages the threaded upper end of the leg (3) and is screwable down the leg (3) so that it will engage the top of the winch and force the leg (3) out of its jamm fit with the socket.

1 Claim, 4 Drawing Figures

ACCESSORY FOR YACHTS

BACKGROUND

This invention relates to an accessory or an accessory mount for yachts.

In my patent application Ser. No. 658,039 now U.S. Pat. No. 4,627,374, dated 10/03/84, there is described an accessory or an accessory mount for a yacht comprising a device not normally involved with the operation of a winch and having an integral supporting leg which is adapted to locate in the handle receiving socket of a winch and be releasably locked to the winch.

SUMMARY

As stated in my aforesaid Patent Application the majority of handle receiving sockets of winches are international size star sockets and so a single size and design of supporting leg will be suitable for most yachts.

The object of the present invention is to provide a cheaper form of accessory or accessory mount which can be advantageously formed from plastics material.

According to the invention an accessory or an accessory mount for a yacht comprises a device not involved with the normal operation of a winch and having an integral supporting leg which is adapted to locate in the handle receiving socket of a winch, and is characterised in that the leg is designed to be a jamm fit in the handle receiving socket, and is threaded at least towards its upper end, a threaded ring engaging the threaded upper end of the leg and being screwable down the leg so that it will engage the top of the winch and force the leg out of its jamm fit with the socket.

One accessory mount in accordance with the invention will now be described by may of example with reference to the accompanying drawings, in which:

DESCRIPTION OF PREFERRED EMBODIMENT

Figure 3:
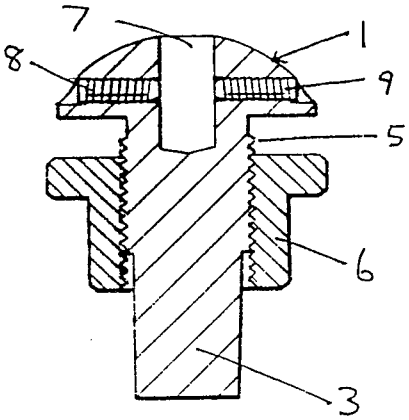
FIG. 3 shows a section on the line III—III of FIG. 1.
Figure 4:
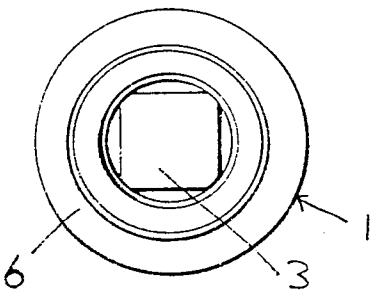
FIG. 4 shows a plan view from below of the mount.
Figure 1:
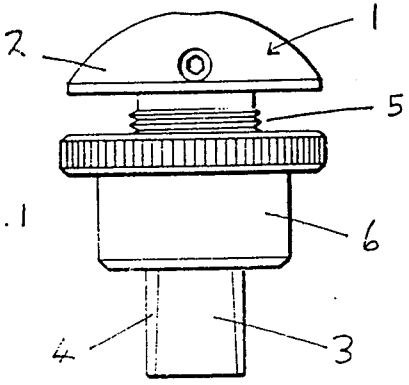
FIG. 1 shows a side view of the mount.
Figure 2:
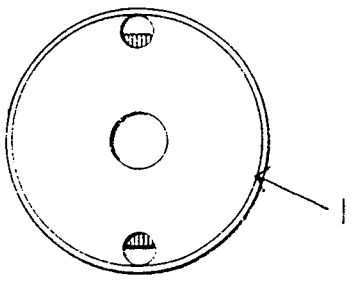
FIG. 2 shows a plan view from above of the mount.

Referring now to the drawings, the mount comprises a device 1 having an accessory mounting head 2 and an integral leg 3 of square cross-section which is adapted to ba a jamm fit in the star socket of the winch. To facilitate the jamm fit, the leg tapers inwardly towards its lower end and has chamfered corners 4.

The upper end of the leg 3 is threaded at 5 and mounted on the thread portion 5 is a threaded ring 6. Thus with the leg 3 jamm fitted into a star socket the ring 6 can be screwed downwardly to release the jamm fit.

The accessory mounting head 2 is generally as described in my patent application Ser. No. 658,039 now U.S. Pat. No. 4,627,374 in that it is part spherical and has a blind bore 7 for receiving a mounting spigot or stud being locked in the bore 7 by one or both grub screws 8 and 9 which threadedly locate in bores extending at right angles to and intersecting the bore 7. The spigot or stud may be shaped as described in my patent application Ser. No. 658,039 now U.S. Pat. No. 4,627,374 so that it is drawn into the bore 7 by the tightening action of the grub screws.

What is claimed is:

1. An accessory or an accessory mount for a yacht comprises a device not involved with the normal operation of a winch and having an integral supporting leg which is adapted to locate in the handle receiving socket of a winch, and is characterised in that the leg is designed to be a jamm fit in the handle receiving socket, and is threaded at least towards its upper end, a threaded ring engaging the threaded upper end of the leg and being screwable down the leg so that it will engage the top of the winch and force the leg out of its jamm fit with the socket.

* * * * *